US011053464B2

(12) United States Patent
Matza et al.

(10) Patent No.: US 11,053,464 B2
(45) Date of Patent: Jul. 6, 2021

(54) SOLVENT COMPOSITION AND PROCESS FOR REMOVAL OF ASPHALT AND OTHER CONTAMINANT MATERIALS

(71) Applicant: United Laboratories International, LLC, Houston, TX (US)

(72) Inventors: Stephen D. Matza, Sugarland, TX (US); Dana M. Archuleta, Pearland, TX (US)

(73) Assignee: United Laboratories International, LLC, Houston, TX (US)

( * ) Notice: Subject to any disclaimer, the term of this patent is extended or adjusted under 35 U.S.C. 154(b) by 0 days.

(21) Appl. No.: 14/580,698

(22) Filed: Dec. 23, 2014

(65) Prior Publication Data

US 2015/0267152 A1 Sep. 24, 2015

Related U.S. Application Data

(60) Provisional application No. 61/969,125, filed on Mar. 22, 2014.

(51) Int. Cl.

| | |
|---|---|
| ***C11D 1/62*** | (2006.01) |
| ***C11D 3/20*** | (2006.01) |
| ***C11D 3/28*** | (2006.01) |
| ***C11D 11/00*** | (2006.01) |
| ***C11D 3/43*** | (2006.01) |
| ***C11D 7/26*** | (2006.01) |
| ***C11D 7/32*** | (2006.01) |
| ***C11D 7/50*** | (2006.01) |

(52) U.S. Cl.

CPC ..... *C11D 11/0041* (2013.01); *C11D 1/62* (2013.01); *C11D 3/2003* (2013.01); *C11D 3/2041* (2013.01); *C11D 3/2093* (2013.01); *C11D 3/28* (2013.01); *C11D 3/43* (2013.01); *C11D 7/26* (2013.01); *C11D 7/266* (2013.01); *C11D 7/3281* (2013.01); *C11D 7/50* (2013.01); *C11D 7/5004* (2013.01)

(58) Field of Classification Search

CPC ..... C11D 1/62; C11D 3/2003; C11D 3/2041; C11D 3/28; C11D 7/26; C11D 7/266; C11D 7/3281; C11D 7/50; C11D 7/5004

USPC ..... 510/238, 475, 500, 504, 505, 506, 433

See application file for complete search history.

(56) References Cited

U.S. PATENT DOCUMENTS

| | | | | |
|---|---|---|---|---|
| 3,813,343 | A | 5/1974 | Mukai et al. | |
| 3,993,555 | A | 11/1976 | Park et al. | |
| 4,046,668 | A | 9/1977 | Farcasiu et al. | |
| 4,347,118 | A | 8/1982 | Funk et al. | |
| 5,225,002 | A | 7/1993 | Stafford et al. | |
| 5,372,741 | A * | 12/1994 | Tomaszewski | C11D 1/94 134/1 |
| 5,562,816 | A | 10/1996 | Roling | |
| 5,720,825 | A * | 2/1998 | Kinnaird | B08B 3/08 134/25.1 |
| 6,117,830 | A * | 9/2000 | Yokosuka | C11D 3/373 510/242 |
| 6,191,087 | B1 | 2/2001 | Opre et al. | |
| 6,281,189 | B1 | 8/2001 | Heimann et al. | |
| 6,369,016 | B1 * | 4/2002 | Vlasblom | C11D 1/83 510/365 |
| 6,689,734 | B2 | 2/2004 | Doyel | |
| 6,833,345 | B2 | 12/2004 | Machac, Jr. et al. | |
| 7,060,301 | B2 | 6/2006 | Wei et al. | |
| 7,288,511 | B2 | 10/2007 | Doyel | |
| 7,462,582 | B2 | 12/2008 | Komiyama | |
| 7,462,587 | B2 * | 12/2008 | Shah | C11D 3/188 510/202 |
| 7,547,672 | B2 | 6/2009 | Zaki | |
| 8,287,658 | B2 * | 10/2012 | Miralles | C11D 1/825 134/25.2 |
| 8,481,474 | B1 * | 7/2013 | Blattner | C11D 7/3245 510/235 |
| 8,716,207 | B2 | 5/2014 | Blattner et al. | |
| 9,074,163 | B2 * | 7/2015 | Garner | B65D 25/08 |
| 2002/0111284 | A1 * | 8/2002 | Machac, Jr. | C09D 9/00 510/245 |
| 2002/0189647 | A1 * | 12/2002 | Labib | A61C 1/0076 134/22.12 |
| 2003/0083220 | A1 * | 5/2003 | Doyel | C11D 7/261 510/412 |

(Continued)

FOREIGN PATENT DOCUMENTS

| | | |
|---|---|---|
| CA | 2821052 | 6/2012 |
| EA | 023408 | 6/2016 |

(Continued)

OTHER PUBLICATIONS

Summary of Data for Chemical Selection—methyl Soyate, 67784-80-9, p. 1-19, Oct. 2010.*

Cargill—Biodiesel Material Safety Data Sheet, p. 1-3, Oct. 2005.*

CHS—Material Safety Data Sheet, Methyl Soyate, p. 1-4, Apr. 2008.*

International Search Report and the Written Opinion of International Application No. PCT/US 15/22051 dated Jul. 2, 2015.

(Continued)

*Primary Examiner* — Gregory R Delcotto

(74) *Attorney, Agent, or Firm* — Tumey L.L.P.

(57) ABSTRACT

A method and composition for removing contaminant material from industrial equipment are disclosed herein. The method includes providing a solvent composition having methyl soyate, N-methylpyrrolidinone, an additional solvent, and a cationic surfactant. The method also includes contacting the contaminant material with the solvent composition and allowing the solvent composition to react with the contaminant material such that at least a portion of the contaminant material is no longer attached to the industrial equipment.

1 Claim, No Drawings

(56) References Cited

U.S. PATENT DOCUMENTS

2003/0119686 A1* 6/2003 Machac, Jr. ..... C09D 9/00 510/201
2003/0130153 A1* 7/2003 Foley ..... C11D 3/2068 510/421
2003/0228996 A1 12/2003 Hei et al.
2004/0116314 A1* 6/2004 Chesky ..... C23G 5/024 510/366
2004/0224861 A1 11/2004 Fuiji
2004/0224870 A1* 11/2004 Doyel ..... C11D 7/509 510/412
2005/0096245 A1 5/2005 Hei et al.
2005/0202989 A1* 9/2005 Wilson ..... C11D 3/044 510/245
2005/0245412 A1* 11/2005 Shah ..... C11D 3/188 510/201
2006/0079423 A1 4/2006 Zaki
2008/0070820 A1 3/2008 Mullen
2008/0139418 A1* 6/2008 Cioletti ..... C10G 1/04 507/261
2008/0139437 A1 6/2008 Power
2008/0261856 A1 10/2008 Nakagawa et al.
2008/0287331 A1 11/2008 Lin et al.
2009/0124524 A1 5/2009 Minor et al.
2009/0124525 A1* 5/2009 Futterer ..... C11D 3/361 510/180
2009/0197793 A1* 8/2009 Inoue ..... C11D 1/662 510/433
2009/0233838 A1* 9/2009 Zaki ..... C11D 3/2093 510/365
2009/0281012 A1* 11/2009 Trivedi ..... C08G 65/3314 510/138
2010/0081596 A1* 4/2010 Rong ..... C11D 1/29 510/218
2010/0273695 A1* 10/2010 Sehgal ..... C08G 65/3314 510/174
2010/0314117 A1 12/2010 Li et al.
2011/0056517 A1* 3/2011 Motsenbocker ..... C11D 3/43 134/6
2011/0166054 A1* 7/2011 Crawford ..... C09D 9/04 510/212
2011/0190187 A1 8/2011 Hawes et al.
2011/0265830 A1 11/2011 Gonzalez
2011/0319312 A1 12/2011 Schwerter et al.
2012/0040880 A1 2/2012 Rieth et al.
2012/0213759 A1* 8/2012 Karsten ..... C11D 1/62 424/94.1
2012/0232170 A1 9/2012 Klinkhammer et al.
2013/0157920 A1 6/2013 Sanchez
2013/0217610 A1* 8/2013 Garner ..... B65D 25/08 510/380
2015/0075561 A1* 3/2015 Dorton ..... C11D 7/5027 134/10
2015/0197710 A1* 7/2015 Garner ..... B65D 25/08 510/380
2015/0252310 A1 9/2015 Blattner et al.
2015/0267152 A1 9/2015 Matza et al.

FOREIGN PATENT DOCUMENTS

WO 1998010033 3/1998
WO 2005108536 11/2005

OTHER PUBLICATIONS

Non-final Office Action for U.S. Appl. No. 15/198,597 dated Nov. 16, 2017.
Australian Examination Report for Application No. 2015236386 dated Feb. 20, 2018.
International Preliminary Report on Patentability for Application No. PCT/US2017/040073 dated Jan. 10, 2019.
USPTO Final Office Action for U.S. Appl. No. 15/198,597 dated Jul. 5, 2018.
USPTO Final Office Action for U.S. Appl. No. 15/198,597 dated Jul. 1, 2019.
Extended European Search Report for Application No. 15769505.7 dated Aug. 31, 2017.
USPTO Non-final Office Action for U.S. Appl. No. 15/198,597 dated Dec. 18, 2018.
Valhoma Corporation, DMSO Industrial Grade—A Technical Grade for Basic Applications, p. 1-2, Feb. 2015.
Chilean Office Action and English Translation for Application No. 201803898 dated Oct. 15, 2019.
Indian Office Action for Application No. 201617032287 dated Aug. 13, 2019.
European Search Report for Application No. 19154867.6 dated May 28, 2019.
USPTO Non-Final Office Action for U.S. Appl. No. 15/198,597 dated Oct. 16, 2019.
Gaylord, "Although Is DMSO safer to use than NMP? How do their physical properties compare?" [Online], Nov. 1, 2015 [retrieved on Jan. 28, 2020]. Retrieved from the Internet: URL:https://www.gaylordchemical.com/wp-content/uploads/2015/11/NMP-vs-DMSO-brochure.pdf.
Extended European Report for Application No. 17821281.7 dated Feb. 4, 2020.
Kazakhstan Office Action and English translation for Application No. 201910075.1 dated Feb. 26, 2020.
Saudi Arabia Examination Report and English Translation for Application No. 516371873 dated Jan. 20, 2019.
Australian Examination Report for Application No. 2019201197 dated Aug. 6, 2019.
Saudi Arabia Office Action and English Translation for Application No. dated May 7, 2020.
Indonesian Office Action for Application No. P00201900751 dated Oct. 26, 2020.
USPTO Non-Final Office Action for U.S. Appl. No. 15/198,597 dated Nov. 23, 2020.
Australia Patent Examination Report No. 1 for Application No. 2017290352 dated Nov. 30, 2020.
Indian Examination and Search Report for Application No. 201917003627 dated Jul. 14, 2020.
USPTO Non-Final Office Action for U.S. Appl. No. 15/198,597 dated Jul. 10, 2020.

* cited by examiner

SOLVENT COMPOSITION AND PROCESS FOR REMOVAL OF ASPHALT AND OTHER CONTAMINANT MATERIALS

CROSS-REFERENCE TO RELATED APPLICATIONS

This application claims priority to U.S. Provisional Patent Application No. 61/969,125, filed on Mar. 22, 2014, titled "Solvent Composition and Process for Removal of Asphalt and Other Contaminant Materials," the entire disclosure of which is herein incorporated by reference.

BACKGROUND OF THE INVENTION

Field of the Invention

This invention relates to the field of industrial facility cleanup and more specifically to the disaggregation and subsequent removal of asphalt and other contaminant materials from industrial equipment.

Background of the Invention

During the refinement process of crude oil or natural gas, contaminant materials such as asphalt, heavy asphaltenic materials, hydrogen-deficient carbonaceous materials, coke, tar, and the like may be produced as byproducts. These contaminant materials may contaminate vessels, tanks, or other types of industrial equipment. The contamination of industrial equipment may lead to problems such as increased downtime or poor processing results.

Numerous approaches to cleaning and decontaminating industrial equipment have been developed. For example, chemical approaches such as citrus-derived water products, water-based products, low boiling petroleum fractions (e.g., naphtha, gasoline, benzene, etc.), turpentine, as well as physical approaches such as freezing and scraping, have all been used to remove contaminant materials with varying degrees of success.

Such conventional approaches may possess various drawbacks. For instance, citrus-derived water products may form emulsions and thus may require emulsion breakers. Water-based products may require extensive separatory effort if any of the hydrocarbons are to be recovered for recycling processes. Additionally, some water-based products may also require a solvent pretreatment to initiate the dissolution of the contaminant materials. Petroleum fractions may be highly flammable and also not easily rinsable with water. Freezing and scraping methods may require additional workers and may only be used in vessels that are accessible to and are safe for those workers. Finally, many of these same approaches are not biodegradable. The lack of biodegradability limits not only the applications for which an approach may be used, but also the operation sites in which it may be used.

Consequently, there is a need for a new solvent composition and process for the removal of contaminant materials.

BRIEF SUMMARY OF SOME OF THE PREFERRED EMBODIMENTS

These and other needs in the art are addressed in an embodiment by a method for removing contaminant material from industrial equipment, the method comprising: providing a solvent composition comprising methyl soyate, N-methylpyrrolidinone, an additional solvent, and a cationic surfactant; contacting the contaminant material with the solvent composition; and allowing the solvent composition to react with the contaminant material such that at least a portion of the contaminant material is no longer attached to the industrial equipment.

These and other needs in the art are addressed in an embodiment by a solvent composition comprising: methyl soyate, N-methylpyrrolidinone, an additional solvent, and a cationic surfactant.

The foregoing has outlined rather broadly the features and technical advantages of the present invention in order that the detailed description of the invention that follows may be better understood. Additional features and advantages of the invention will be described hereinafter that foam the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

DETAILED DESCRIPTION OF THE PREFERRED EMBODIMENTS

In embodiments, a solvent composition comprises a mixture of three solvents and a cationic surfactant. The first solvent is methyl soyate. The second solvent is N-methylpyrrolidinone. The third solvent may be any solvent suitable for maintaining the cationic surfactant in solution (e.g., alcohols, esters, ketones, and the like). Without limitation, the solvent composition may disaggregate and/or dissolve contaminant materials from industrial equipment in industrial facilities (e.g., oil refineries, natural gas processing plants, petrochemical facilities, port terminals, and the like). In embodiments, the solvent composition may be used to remove a contaminant material from any industrial equipment used in industrial facilities including vessels, tanks, vacuum towers, heat exchangers, piping, distillation columns, and the like. In embodiments, contaminant materials to be removed may include any contaminant material produced, stored, transported, or the like during the process of crude oil refinement, natural gas processing, hydrocarbon transport, hydrocarbon processing, hydrocarbon cleanup, and the like. In embodiments, examples of contaminant materials include asphalt, heavy asphaltenic materials, hydrogen-deficient carbonaceous materials, coke, tar, heavy oil deposits, hydrocarbon sludge, lube oil, the like, or any combinations thereof. In embodiments, the contaminant materials are contacted with the solvent composition, such that the contaminant materials are disaggregated and/or dissolved and may then be subsequently removed from industrial equipment.

Embodiments of the solvent composition comprise the solvent methyl soyate (MESO). MESO is a biodegradable long-chain fatty acid. The solvent composition may have any wt. % of MESO suitable for disaggregating and/or dissolving contaminant materials such that at least a portion of a contaminant material may be removed from industrial equipment. For instance, the contaminant material may be removed from the surface of industrial equipment. In an embodiment, the solvent composition has between about 20.0 wt. % MESO and about 40.0 wt. % MESO, alternatively between about 25.0 wt. % MESO and about 35.0 wt. % MESO. In some embodiments, the MESO may comprise about 30.0 wt. % of the solvent composition. With the benefit of this disclosure, one having ordinary skill in the art will be able to select an appropriate amount of MESO for a chosen application.

Embodiments of the solvent composition comprise the solvent N-methylpyrrolidone (NMP). NMP is a biodegradable lactam. The solvent composition may have any wt. % of NMP suitable for disaggregating and/or dissolving contaminant materials such that at least a portion of a contaminant material may be removed from industrial equipment. In an embodiment, the solvent composition has between about 20.0 wt. % NMP and about 50.0 wt. % NMP, alternatively between about 25.0 wt. % NMP and about 35.0 wt. % NMP. In some embodiments, the NMP may comprise about 32.0 wt. % of the solvent composition. With the benefit of this disclosure, one having ordinary skill in the art will be able to select an appropriate amount of NMP for a chosen application.

Embodiments of the solvent composition comprise a third solvent (TS). The third solvent may be any solvent, or combination of solvents, suitable for maintaining the cationic surfactant in solution and/or for lowering the surface tension of the solvent composition. Without limitation, the third solvent facilitates the contaminant material removal process. The TS may be an alcohol, an ester, an ether, the like, or any combinations thereof. In some embodiments, the alcohol may include dipropylene glycol, propylene glycol, simple alcohols ranging from $C_8$ to $C_{18}$ (e.g., octanol, dodecanol), the like, or any combinations thereof. In some embodiments, the ester may include ethyl acetate, isobutyl acetate, glycol esters (e.g., glycol stearate, monoglycerides such as glyceryl stearate, etc.), the like, or any combinations thereof. In some embodiments, the ether may include a glycol such as dipropylene glycol, or an alkyl glucoside such as decyl glucoside, the like or any combinations thereof. In some embodiments, the TS, in addition to maintaining the cationic surfactant in solution, possesses a low boiling point, low toxicity, biodegradability, or any combinations thereof. The solvent composition may have any wt. % of the TS suitable for keeping the cationic surfactant in solution and/or lowering the surface tension of the solvent composition, which without limitation facilitates the contaminant removal process. In an embodiment, the solvent composition has between about 20.0 wt. % TS and about 40.0 wt. % TS, alternatively between about 25.0 wt. % TS and about 35.0 wt. % TS. In some embodiments, the TS may comprise about 30.0 wt. % of the solvent composition. With the benefit of this disclosure, one having ordinary skill in the art will be able to select an appropriate amount of the TS for a chosen application.

Embodiments of the solvent composition comprise a cationic surfactant. The cationic surfactant may be any cationic surfactant or combination of cationic surfactants suitable for use in the solvent composition. The cationic surfactant may be a quaternary ammonium salt such as an imidazole derivative. Without limitation, specific examples of the cationic surfactant include heterocycles (e.g., isostearyl ethylimidazolinium ethosulfate (ISES), etc.), alkyl-substituted pyridines, morpholinium salts, alkyl ammonium salts (e.g., cetyl trimethylammonium bromide, stearalkonium chloride, dimethyldioctadecylammonim chloride, etc.), the like, or any combinations thereof. The solvent composition may have any wt. % of the cationic surfactant for disaggregating and/or dissolving contaminant materials such that at least a portion of a contaminant material may be removed from industrial equipment. In some embodiments, the cationic surfactant may have detergent properties such as disaggregation and emulsification. In an embodiment, the solvent composition has between about 4.0 wt. % cationic surfactant and about 12.0 wt. % cationic surfactant, alternatively between about 6.0 wt. % cationic surfactant and about 10.0 wt. % cationic surfactant. In some embodiments, the cationic surfactant may comprise about 8.0 wt. % of the solvent composition. With the benefit of this disclosure, one having ordinary skill in the art will be able to select an appropriate amount of cationic surfactant for a chosen application.

In optional embodiments, the solvent composition may comprise a dispersant. The dispersant may be any dispersant suitable for preventing the settling of any components in the solvent composition. Examples of suitable dispersants include, without limitation, sulfonated-formaldehyde-based dispersants, polycarboxylated ether dispersants, naphthalene sulfonate dispersants, the like, or any combinations thereof. The solvent composition may have any wt. % of the dispersant suitable for preventing the settling of any of the solvent composition components. In an embodiment, the solvent composition has between about 1 wt. % dispersant and about 10 wt. % dispersant, alternatively between about 2 wt. % dispersant and about 7 wt. % dispersant. In some embodiments, the dispersant may comprise about 3 wt. % of the solvent composition. With the benefit of this disclosure, one having ordinary skill in the art will be able to select an appropriate amount of dispersant for a chosen application.

In embodiments, the solvent composition may be prepared by mixing the MESO, NMP, and the TS together prior to the addition of the cationic surfactant. Without being limited by theory, mixing the MESO, the NMP, and the TS prior to the addition of the cationic surfactant may improve mixability. In embodiments, the MESO, NMP, and the TS may be mixed together in any order. Moreover, once the MESO, NMP, the TS, and the cationic surfactant have been mixed together to create the solvent composition, the solvent composition may be stored until desired for use. In optional embodiments wherein the solvent composition also comprises a dispersant, the dispersant may be added to the solvent composition at any time during preparation of the solvent composition. The solvent composition may be prepared under any suitable conditions. In embodiments, the solvent composition may be prepared at ambient temperature and pressure.

In optional embodiments, the solvent composition may be diluted with a diluent. In these optional embodiments, the diluent may comprise any suitable diluent that may dilute the solvent composition. In embodiments, the diluent may comprise diesel fuel, biodiesel fuel, fuel oil, light sweet crude oil, water, the like, or any combinations thereof. Without being limited by theory, the diluent may decrease the potency of the solvent composition, but not otherwise affect the efficacy. In optional embodiments, the solvent composition has from about 1 wt. % to about 99 wt. % diluent, alternatively from about 80 wt. % to about 90 wt. % diluent, and further alternatively from about 90 wt. % to about 99 wt. % diluent. In an embodiment, the solvent composition has about 95 wt. % diluent, alternatively about 99 wt. % diluent. With the benefit of this disclosure, one having ordinary skill in the art will be able to select an appropriate amount of diluent for a chosen application.

In embodiments, a contaminant material removal process comprises contacting the contaminant materials and/or the industrial equipment with the solvent composition. For example, in embodiments comprising a vessel containing contaminant materials disposed within, the solvent composition is introduced into the vessel. The solvent composition may be introduced into the vessel by any suitable means such that the solvent composition contacts the contaminant materials disposed therein. In embodiments, the solvent composition is poured, pumped, injected, or the like, or any combinations thereof. As another example, in embodiments comprising industrial equipment having contaminant materials disposed thereon, the solvent composition may be poured onto the contaminated portion of the industrial equipment, or the contaminated portion of the industrial equipment may be submerged in the solvent composition such that the solvent composition contacts the contaminant materials disposed thereon.

In optional embodiments, the contaminant material removal process may include the addition of heat to the solvent composition. The heat may be added by any suitable means such as steam, heated coils, the like, or any combinations thereof. In further optional embodiments, the solvent composition is heated to a temperature between about ambient temperature and about 300° F., alternatively between about 100° F. and about 200° F., and further alternatively between about 120° F. and about 180° F. The heat may be applied to the solvent composition prior to the solvent composition contacting a contaminant material or concurrently while the solvent composition is contacting a contaminant material. In embodiments, the solvent composition is agitated when disposed in industrial equipment such as a vessel. Without limitation, in these optional embodiments, the heat is added to facilitate the disaggregation and/or dissolution process between the solvent composition and the contaminant materials.

In optional embodiments, the contaminant material removal process may include the addition of agitation to the solvent composition. The agitation may be added by any suitable means such as stirring, shaking, pumping, the like, or any combinations thereof. The agitation may be applied to the solvent composition prior to the solvent composition contacting a contaminant material or concurrently while the solvent composition is contacting a contaminant material. Without limitation, in these optional embodiments, the agitation is added to facilitate the disaggregation and/or dissolution process between the solvent composition and the contaminant materials. In further optional embodiments, the solvent composition may be both agitated and heated as described above.

The solvent composition may be in the industrial equipment for any suitable period of time to allow the solvent composition in contact with the contaminant material to remove at least a portion of the contaminant material from the industrial equipment (i.e., disaggregated or dissolved). In embodiments comprising a diluent, the length of the timeframe may be dictated by the amount that the solvent composition is diluted. In an embodiment, the timeframe is from about one minute to about three weeks. In alternative embodiments, the time frame is from about one hour to about forty-eight hours. In further alternative embodiments, the time frame is from about one hour to about six hours.

In embodiments, the solvent composition may be introduced to industrial equipment in amounts to provide sufficient solvent composition to successfully remove at least a portion of the contaminant materials from the surfaces on which the contaminant materials are disposed. In embodiments, this amount is an amount sufficient for the solvent composition to contact the contaminant materials for an amount of time sufficient to disaggregate and/or dissolve the contaminant materials. For instance, the solvent composition may be introduced to industrial equipment in an amount in relation to the contaminant material (i.e., weight ratio of solvent composition to contaminant material) between about 100:1 weight ratio and about a 1:1 weight ratio, alternatively between about a 10:1 weight ratio and about a 1:1 weight ratio. For example, the solvent composition to contaminant material ratio may comprise about a 50:1 weight ratio, alternatively about a 20:1 weight ratio, and further alternatively about a 5:1 weight ratio.

In embodiments, once the contaminant materials have been disaggregated and/or dissolved, the contaminant materials may reside in the solvent composition and may therefore be fluid and/or flowable within the solvent composition. The contaminant materials residing within the solvent composition may be removed from the industrial equipment by any suitable means. In embodiments, the solvent composition is pumped, poured, or the like, or any combinations thereof from the industrial equipment along with the solvent composition.

In optional embodiments, the surface that was contaminated by a contaminant material may be cleaned after the contaminant material has been contacted by the solvent composition. Without limitation, cleaning the surface may remove additional particulates and/or residue of the contaminant material. The cleaning may be accomplished by any suitable methods such as rinsing, spraying, scrubbing, and the like. Rinsing and/or spraying may be accomplished by any suitable method including rinsing and/or spraying with water, aqueous surfactant solutions, hydrocarbon solvents, or any combinations thereof.

In optional embodiments, the contaminant materials may be recovered and/or recycled. The process of recovery and/or recycle may comprise transferring the disaggregated and/or dissolved contaminant materials to a high temperature and high pressure oven (e.g., a coker unit) to "crack" the heavy hydrocarbons into small usable fragments. In embodiments, a catalytic cracker uses hydrogen injection as well as high temperature and a catalyst to crack and "hydrogenate" hydrocarbons into smaller pieces. Such a process may reduce contaminant materials to smaller usable hydrocarbons such that they may be recycled for further processing and use.

In some embodiments, the solvent composition may be biodegradable as defined by the Operation for Economic Co-Operation and Development (OECD) Biodegradation Test 301D. An example embodiment of a biodegradable solvent composition includes about 30.0 wt. % MESO, about 32.0 wt. % NMP, about 30.0 wt. % dipropylene glycol (i.e. the TS), and about 8.0 wt. % ISES (i.e. the cationic surfactant).

In optional embodiments, the solvent composition may be used in conjunction with other products used to treat industrial equipment for contaminant materials or otherwise unwanted materials. For example, the solvent composition may be used to treat contaminant materials concurrently with a sodium nitrite solution used to treat sour water. Examples of sodium nitrite solutions are disclosed in U.S. patent application Ser. No. 12/415,283, the entirety of which is incorporated herein by reference. In other optional embodiments, the solvent composition may be used in conjunction with other organic solvents and/or organic solvent additives to dissolve and/or soften contaminant materials and the like. Examples include the organic solvent Rezyd-X®, a registered trademark of United Laboratories International, LLC; the organic solvent additive HOB®, a registered trademark of United Laboratories International, LLC; Zyme-Flow® UN657, a registered trademark of United Laboratories International, LLC; Zyme-Ox® Plus Z50, a registered trademark of United Laboratories International, LLC; the like; or any combinations thereof.

To facilitate a better understanding of the present embodiments, the following examples of certain aspects of some embodiments are given. In no way should the following examples be read to limit, or define, the entire scope of the embodiments.

Example 1

The following example was a comparative illustration between the solvent composition and heavy aromatic naphtha (HAN), which is a traditional solvent used to treat some types of contaminant materials.

A solvent composition was prepared with the following mix of components.

TABLE 1

Solvent Composition Makeup

| Component | Wt. % |
|---|---|
| MESO | 30.0 |
| NMP | 32.0 |
| Dipropylene Glycol | 30.0 |
| ISES | 8.0 |

The solvent composition was diluted to a strength of 5% by the addition of diesel fuel. The contaminant material chosen for testing was a piece of asphalt obtained from a refinery tank. Two equal sized portions of the asphalt, each comprising the same weight of 1 g, were added to two clear vials such that the asphalt was affixed to the bottom of the vials. 3 mL of the HAN solution were added to one vial, and 3 ml of the 5% solvent composition in diesel were added to the other vial. This amount was sufficient to completely submerge the asphalt sample in each vial. Both vials were then placed on a hot plate and heated over a three hour period to temperatures ranging from between 155° F. and 175° F. The samples were not stirred or otherwise agitated. After three hours, the samples were removed from the hot plate and a visual inspection was made. The samples were then allowed to cool overnight. A visual inspection of the samples was made the next day after the cooling period of 14 hours. The results are described in Table 2 below.

TABLE 2

Asphalt Treatment Observations

| Sample | Observations after heating | Observations after cooling |
|---|---|---|
| 5% Solvent Composition | No residue | No residue |
| HAN | No residue | Residue present |

The results indicate that although both the solvent composition and HAN solution were effective in removing asphalt from a vial in the presence of heat, only the solvent composition was able to keep the vial surface free from asphalt residue once the heat was removed. Additionally, both solutions were homogeneous fluids when hot. The solvent composition remained so upon cooling, whereas the HAN solution showed some small "clumps" embodied in the liquid upon cooling.

Example 2

The following example illustrates the effectiveness of the solvent composition on various types of contaminant materials.

A solvent composition was prepared with the following mix of components.

TABLE 3

Solvent Composition Makeup

| Component | Wt. % |
|---|---|
| MESO | 30.0 |
| NMP | 32.0 |
| Dipropylene Glycol | 30.0 |
| ISES | 8.0 |

The solvent composition was split into three samples. Sample 1 was undiluted. Sample 2 was diluted to a strength of 5% by the addition of diesel fuel. Sample 3 was diluted to a strength of 5% by the addition of water. The contaminant material chosen for testing was a piece of vacuum tower bottom obtained from a refinery. Three equal sized portions of the vacuum tower bottom, each comprising the same weight of 1 g, were added to three clear vials such that the vacuum tower bottom was affixed to the bottom of the vials. The weight ratio of the solvent composition sample to the contaminant material was 20:1. This ratio was sufficient to completely submerge the vacuum tower bottom in each vial. All three vials were placed on a hot plate and heated over a 2 hour period at a temperature of 140° F. The samples were not stirred or otherwise agitated. The samples were then removed from the hot plate and a visual inspection was made. The samples were then allowed to cool overnight. A visual inspection of the samples was made the next day after the overnight cooling period of 14 hours. The results are described in Table 4 below.

TABLE 4

Vacuum Tower Bottom Treatment Observations

| Sample | Observations after heating | Observations after cooling |
|---|---|---|
| Sample 1 | No residue, complete dissolution | No residue, complete dissolution |
| Sample 2 | No residue, incomplete dissolution, sample was suspended in solution | No residue, incomplete dissolution, sample was suspended in solution |
| Sample 3 | No residue, incomplete dissolution, sample was suspended in solution | No residue, incomplete dissolution, sample was suspended in solution |

The results indicated that although the solvent composition was most effective when undiluted, even at 5% strength the solvent composition was able to remove the contaminant from the surface of the vial and keep it suspended in solution.

A second experiment was performed using identical experimental parameters, except the contaminant material was a combination of vacuum tower bottom and asphalt. To reiterate, Sample 1 was undiluted. Sample 2 was diluted to a strength of 5% by the addition of diesel fuel. Sample 3 was diluted to a strength of 5% by the addition of water. The results were presented in Table 5 below.

TABLE 5

Vacuum Tower Bottom and Asphalt Treatment Observations

| Sample | Observations after heating | Observations after cooling |
|---|---|---|
| Sample 1 | No residue, complete dissolution | No residue, complete dissolution |

TABLE 5-continued

| Vacuum Tower Bottom and Asphalt Treatment Observations | | |
|---|---|---|
| Sample | Observations after heating | Observations after cooling |
| Sample 2 | No residue, complete dissolution | No residue, complete dissolution |
| Sample 3 | Residue present, incomplete dissolution, sample was suspended in solution | Residue present, incomplete dissolution, sample was suspended in solution |

The results indicated that solvent composition effectiveness may be due to the type of contaminant material treated as well as the diluent selected.

Example 3

The following example is to illustrate the effectiveness of the solvent composition with only minimal heating over extended periods of time.

A solvent composition was prepared with the following mix of components.

TABLE 6

| Solvent Composition Makeup | |
|---|---|
| Component | Wt. % |
| MESO | 30.0 |
| NMP | 32.0 |
| Dipropylene Glycol | 30.0 |
| ISES | 8.0 |

The solvent composition was split into two samples. Sample 1 was diluted to a strength of 5% by the addition of biodiesel. Sample 2 was diluted to a strength of 5% by the addition of fuel oil. The contaminant material chosen for testing was a piece of a hydrocarbon deposit obtained from an underground vessel in a refinery. This vessel was submerged such that it would only be possible to apply limited heat and no agitation to any solvent composition pumped within. Two equal sized portions of the hydrocarbon deposit, each comprising the same weight of 2 g, were added to two clear vials such that the hydrocarbon deposit was affixed to the bottom of the vials. 7.5 mL of Sample 1 and 7.5 ml of Sample 2 were added to the separate vials to completely submerge the hydrocarbon deposit in each vial. Both vials were placed on a hot plate and heated for a one week period at a temperature of 100° F. The samples were not stirred or otherwise agitated. The samples were then removed from the hot plate and a visual inspection was made. The results are presented in Table 7 below.

TABLE 7

| 5% Solvent Composition Treatment Observations | |
|---|---|
| Sample | Observation |
| Sample 1 (Biodiesel Diluent) | Some dissolution |
| Sample 2 (Fuel Oil Diluent) | Some dissolution |

The solvent concentrations of both samples were doubled to 10%, and both samples were heated again for another week at 100° F. The results are presented in Table 8 below.

TABLE 8

| 10% Solvent Composition Treatment Observations | |
|---|---|
| Sample | Observation |
| Sample 1 (Biodiesel Diluent) | Continued dissolution |
| Sample 2 (Fuel Oil Diluent) | Continued dissolution |

The solvent concentrations of both samples were doubled again, and both samples were then heated again for a third week at 100° F. The results are presented in Table 9 below.

TABLE 9

| 20% Solvent Composition Treatment Observations | |
|---|---|
| Sample | Observation |
| Sample 1 (Biodiesel Diluent) | Complete dissolution |
| Sample 2 (Fuel Oil Diluent) | Continued dissolution |

The results indicated that the solvent composition continued to work for extended periods of time even when only minimal heat is applied.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention. If there is any conflict in the usages of a word or term in this specification and one or more patent(s) or other documents that may be incorporated herein by reference, the definitions that are consistent with this specification should be adopted.

What is claimed is:

1. A solvent composition for removing a contaminant material from industrial equipment, the solvent composition comprising:

methyl soyate, wherein the methyl soyate comprises about 25 wt. % to about 35 wt. % of the solvent composition;

N-methylpyrrolidinone, wherein the N-methylpyrrolidinone comprises about 25 wt. % to about 35 wt. % of the solvent composition, an additional solvent, wherein the additional solvent is dipropylene glycol and comprises about 25 wt. % to about 35 wt. % of the solvent composition, a diluent comprising diesel fuel, wherein the diesel fuel is not biodiesel fuel;

a cationic surfactant, wherein the cationic surfactant is isostearyl ethylimidazolinium ethosulfate, wherein the isostearyl ethylimidazolinium ethosulfate comprises about 6 wt. % to about 10 wt. % of the solvent composition;

a dispersant, wherein the dispersant is sulfonated-formaldehyde-based; and wherein a weight ratio of the solvent composition to the contaminant material is between about 100:1 and about 1:1, wherein the contaminant material comprises at least one material selected from the group consisting of asphalt, heavy asphaltenic materials, hydrogen-deficient carbonaceous materials, coke, tar, heavy oil deposits, hydrocarbon sludge, lube oil, and any combination thereof.

* * * * *